US010601177B1

(12) United States Patent
Probert et al.

(10) Patent No.: US 10,601,177 B1
(45) Date of Patent: Mar. 24, 2020

(54) ELECTRICAL CONNECTOR LOCK WITH REVERSE STOP

(71) Applicant: Lear Corporation, Southfield, MI (US)

(72) Inventors: Deborah Probert, Farmington Hills, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/124,564

(22) Filed: Sep. 7, 2018

(51) Int. Cl.
*H01R 13/629* (2006.01)

(52) U.S. Cl.
CPC . *H01R 13/62938* (2013.01); *H01R 13/62961* (2013.01)

(58) Field of Classification Search
CPC ..... H01R 13/62938; H01R 13/62955; H01R 13/62944; H01R 13/6295; H01R 13/62977; H01R 13/641; H01R 13/62927; H01R 13/62933; H01R 13/62966; H01R 13/62922; H01R 13/631; H01R 13/633
See application file for complete search history.

(56) References Cited

U.S. PATENT DOCUMENTS 5,476,390 A * 12/1995 Taguchi ..... H01R 13/62938 439/155
6,325,647 B1 * 12/2001 May ..... H01R 13/6295 439/157
6,368,125 B1 * 4/2002 Gundermann ... H01R 13/62944 439/157
6,540,532 B1 * 4/2003 Martin ..... H01R 13/62944 439/157
6,644,992 B2 * 11/2003 Maegawa ..... H01R 13/62938 439/157
6,655,971 B2 * 12/2003 Maegawa ..... H01R 13/62933 439/157
6,755,674 B2 * 6/2004 Fujii ..... H01R 13/506 439/157
6,767,231 B1 * 7/2004 Martin ..... H01R 13/62944 439/157
6,857,892 B2 * 2/2005 McLauchlan ..... H01R 13/6272 439/352
7,044,758 B2 * 5/2006 Deno ..... H01R 13/62955 439/157
7,052,294 B1 5/2006 Osada
7,137,835 B2 * 11/2006 Shiga ..... H01R 13/62938 439/157
7,137,844 B2 * 11/2006 Flowers ..... H01R 13/5812 439/372

(Continued)

*Primary Examiner* — Edwin A. Leon
*Assistant Examiner* — Matthew T Dzierzynski
(74) *Attorney, Agent, or Firm* — MacMillan, Sobanski & Todd, LLC

(57) ABSTRACT

An electrical connector includes an electrical connector housing and a lever that is movable relative to the electrical connector housing between a pre-mate position and a final position. The electrical connector includes a lock with a catch that is movable relative to the lever between an open position and a closed position. The catch retains in the lever in the final position when the catch is in the closed position. The catch can be moved in a forward direction relative to the lever to allow the lever to move from the closed position to the open position. The catch moves in a reverse direction relative to the lever when the lever is moved toward the pre-mate position when the catch is in the closed position.

18 Claims, 5 Drawing Sheets

(56) References Cited

U.S. PATENT DOCUMENTS 7,175,451 B2 * 2/2007 Shuey ..... H01R 13/62955 439/157
7,267,564 B2 * 9/2007 Bauman ..... H01R 13/62955 439/157
7,270,553 B2 * 9/2007 Matsubara ..... H01R 13/62955 439/157
7,384,285 B2 * 6/2008 Patterson ..... H01R 13/62955 439/157
7,407,396 B2 * 8/2008 Dillon ..... H01R 13/62933 439/157
7,410,374 B2 8/2008 Okuda et al.
7,419,390 B2 9/2008 Ohtaka et al.
7,559,779 B1 * 7/2009 Caines ..... H01R 13/62938 439/157
7,563,114 B2 7/2009 Patterson
7,726,988 B2 * 6/2010 Martin ..... H01R 13/633 439/157
7,749,004 B2 * 7/2010 Shuey ..... H01R 13/62955 439/157
7,922,503 B1 * 4/2011 Kobayashi ..... H01R 13/6295 439/157
8,356,999 B2 * 1/2013 Imai ..... H01R 13/62944 439/157
8,662,906 B2 3/2014 Schmitt et al.
8,979,567 B2 * 3/2015 Kamiya ..... H01R 13/62977 439/157
9,281,614 B1 * 3/2016 Bonucci ..... H01R 13/62927
9,472,895 B2 * 10/2016 Kataoka ..... H01R 13/62938
9,653,846 B1 5/2017 Caldwell et al.
9,774,127 B2 * 9/2017 Yamaki ..... H01R 13/506
2003/0190836 A1 * 10/2003 Yamashita ..... H01R 13/62938 439/489
2005/0148221 A1 * 7/2005 Miyamoto ..... H01R 13/62955 439/157
2006/0040535 A1 * 2/2006 Koshy ..... H01R 13/62977 439/157
2006/0270257 A1 * 11/2006 Duval ..... H01R 13/62938 439/157
2006/0281350 A1 * 12/2006 Yamamoto ..... H01R 13/4361 439/157
2006/0292907 A1 * 12/2006 Nishide ..... H01R 13/447 439/157
2008/0248664 A1 * 10/2008 Shibata ..... H01R 13/62938 439/157
2009/0023317 A1 * 1/2009 Mizoguchi ..... H01R 13/62938 439/157
2009/0163059 A1 * 6/2009 Kobayashi ..... H01R 13/62938 439/151

* cited by examiner

ELECTRICAL CONNECTOR LOCK WITH REVERSE STOP

BACKGROUND OF THE INVENTION

This invention relates to an electrical connector with a lock. More specifically, this invention relates to an electrical connector with a lock having a stop to prevent excessive deflection of the lock.

An electrical connector assembly typically includes a pair of electrical connectors that can be mated in order to mate multiple pairs of electrical terminals that are respectively housed in the electrical connectors. A lock can be included on the electrical connector assembly in order to prevent the two electrical connectors from coming apart after they are mated. This is particularly helpful in an environment where the electrical connector assembly may be subjected to vibrations or other forces that could cause the electrical connectors to move apart.

One type of lock is a biased hook provided on one of the electrical connectors that engages with the other one of the electrical connectors in order to prevent relative movement. The biased hook is deflected during engagement of the electrical connectors and rebounds into a closed position, where it engages a strike in order to prevent the electrical connectors from being separated. One type of biased hook includes is integrally formed as part of one of the components of the electrical connector assembly. The hook is supported by a resilient piece, which allows the hook to move relative to the component with which it is integrally formed.

If the lock is in the closed position and a force is applied to move the electrical connectors apart, the hook engages the strike and resists relative movement. Thus, the lock may need to support a load that is induced by this applied force. It would be desirable to have an alternative lock design for an electrical connector assembly.

SUMMARY OF THE INVENTION

The invention relates to an electrical connector. The electrical connector includes an electrical connector housing and a handle that is movable relative to the electrical connector housing between a pre-mate position and a final position. The electrical connector also includes a lock having a catch that is movable relative to the handle between an open position and a closed position. The catch retains in the handle in the final position when the catch is in the closed position. The catch moves in a forward direction relative to the handle to move from the closed position to the open position. The catch moves in a reverse direction relative to the handle when the handle is moved from the final position toward the pre-mate position when the catch is in the closed position.

In another embodiment, the invention relates to an electrical connector with an electrical connector housing and a lever mounted on the electrical connector housing for relative rotational movement. The lever is movable between a pre-mate position and a final position. A catch is attached to a handle of the lever for relative movement in a forward direction and a reverse direction. The catch is adapted to engage a strike on the electrical connector housing to retain the lever in the final position. A forward stop on the lever limits the movement of the catch in the forward direction. A reverse stop on the lever limits the movement of the catch in the reverse direction.

In another embodiment, the invention relates to an electrical connector assembly. The assembly includes a first electrical connector with an electrical connector housing and a lever. The assembly also includes a second electrical connector. The electrical connector housing includes a strike with a strike surface. The lever includes two arms that are joined by a handle. Each arm of the lever is attached to an axle post on the electrical connector housing, and the lever is rotatable relative to the electrical connector housing between a pre-mate position and a final position. The lever is adapted to engage the second electrical connector to move the second electrical connector into a mated position relative to the first electrical connector when the lever is moved to the final position. The lever is also adapted to move in an unmate direction from the final position to the pre-mate position. The lever includes a base. A catch is attached to the lever base by one or more catch legs. The catch includes a retention surface. The catch is adapted to move relative to the base between an open position and a closed position. The lever also includes a lock cage that is attached to the base by one or more cage supports. The catch is adapted to move in a forward direction relative to the lever from the closed position to the open position. The catch is also adapted to move in a forward direction to engage the base. When the catch is in the closed position and the lever is in the final position, the retention surface is adjacent to the strike surface. Additionally, the retention surface and the strike surface are nearest to each other near the catch and extend apart from each other. When the catch is in the closed position, the lever is in the final position, and the lever is moved in the unmate direction, the retention surface engages the strike surface, and the catch is adapted to move in a reverse direction relative to the base to a reverse stopped position. When the catch is in the reversed stopped position, a portion of the catch is engaged with the lock cage and is located in the unmate direction from the lock cage.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
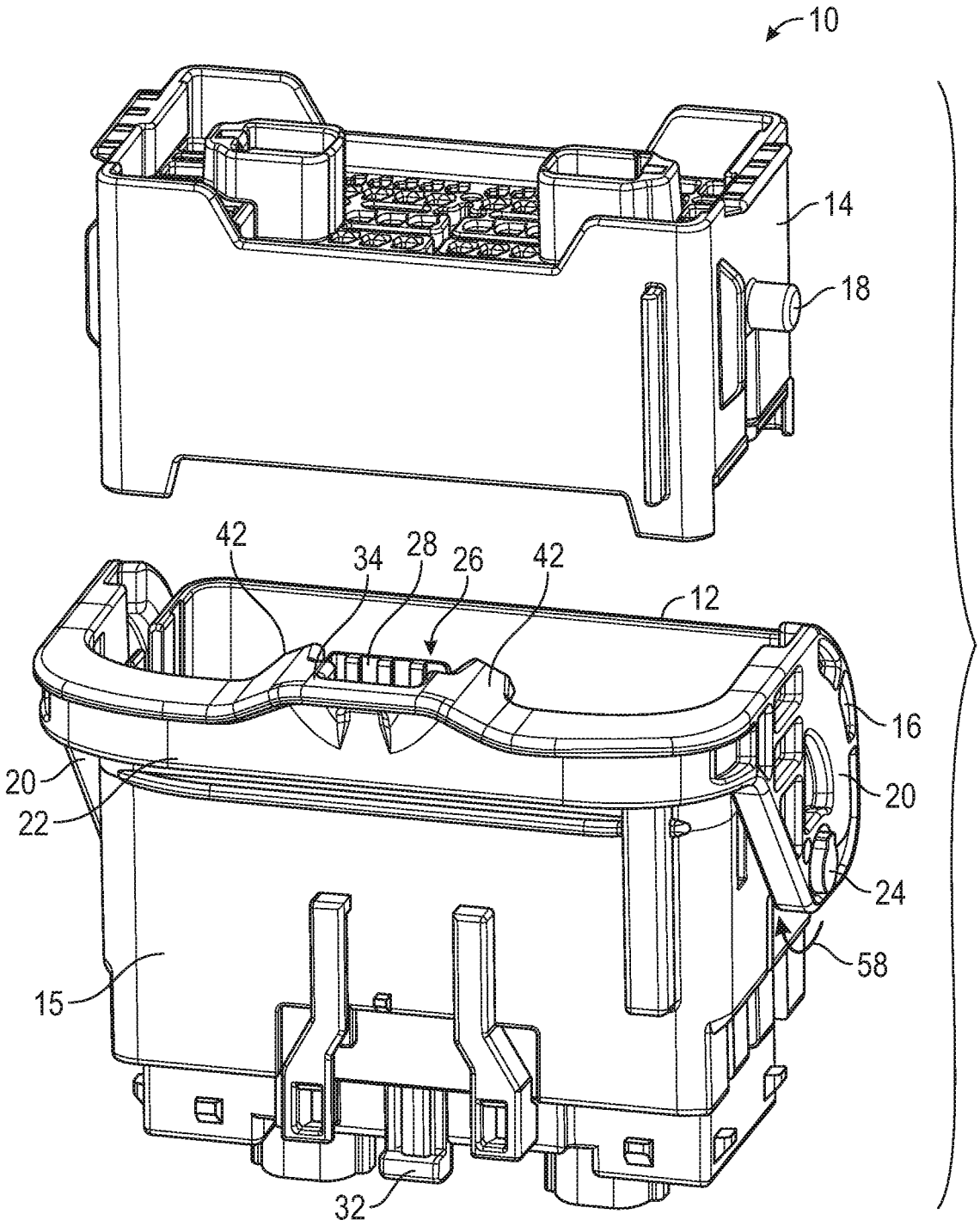
FIG. 1 is an exploded perspective view of an electrical connector assembly including a first electrical connector, a second electrical connector, and a lever.

Referring now to the drawings, there is illustrated in FIG. 1 an exploded[M] perspective view of an electrical connector assembly, indicated generally at 10. The electrical connector assembly 10 includes a first electrical connector 12 and a second electrical connector 14. The first electrical connector 12 is adapted to hold a plurality of electrical terminals (not shown), and the second electrical connector 14 is adapted to hold a plurality of corresponding electrical terminals (not shown). The illustrated first electrical connector 12 can accommodate up to 62 male electrical terminals, but may accommodate any desired number, type, or size of electrical terminal. Similarly, the illustrated second electrical connector 14 can accommodate up to 62 female electrical terminals, but may also accommodate any desired number, type, and size of electrical terminal.

The illustrated first electrical connector 12 includes an electrical connector housing 15 and a lever 16 that mounted on the electrical connector housing 15 for relative rotational movement. The lever 16 engages two travel pegs 18 (one is visible in FIG. 1) located on the second electrical connector 14 and may be moved by an operator to pull the second electrical connector 14 into a mated position relative to the first electrical connector 12, as is known in the art. In FIG. 1, the first electrical connector 12 and the second electrical connector 14 are shown prior to being mated, and the lever 16 is shown in a pre-mate position.

The lever 16 includes two parallel arms 20 that are joined by a handle 22. Each of the arms 20 is attached to an axle post 24 (one is visible in FIG. 1) located on the first electrical connector 12 so that the lever 16 is able to rotate about the axle posts 24. The lever 16 may be moved from the pre-mate position shown in FIG. 1 to a final position when the second electrical connector 14 has been moved into the mated position relative to the first electrical connector 12. The electrical connector assembly 10 includes a lock, indicated generally at 26, that retains the lever 16 in the final position relative to the electrical connector housing 15. The illustrated lock 26 is located on the handle 22 of the lever 16, but may be located in any desired location.

Figure 2:
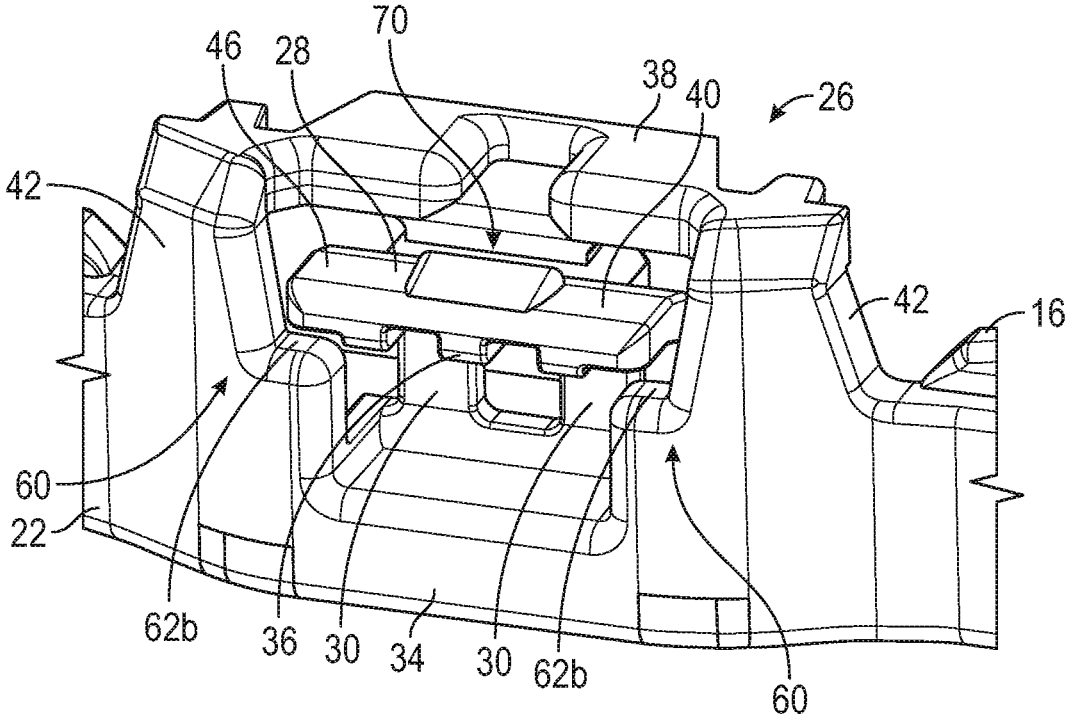
FIG. 2 is an enlarged perspective view of a portion of the lever including a lock.
Figure 3:
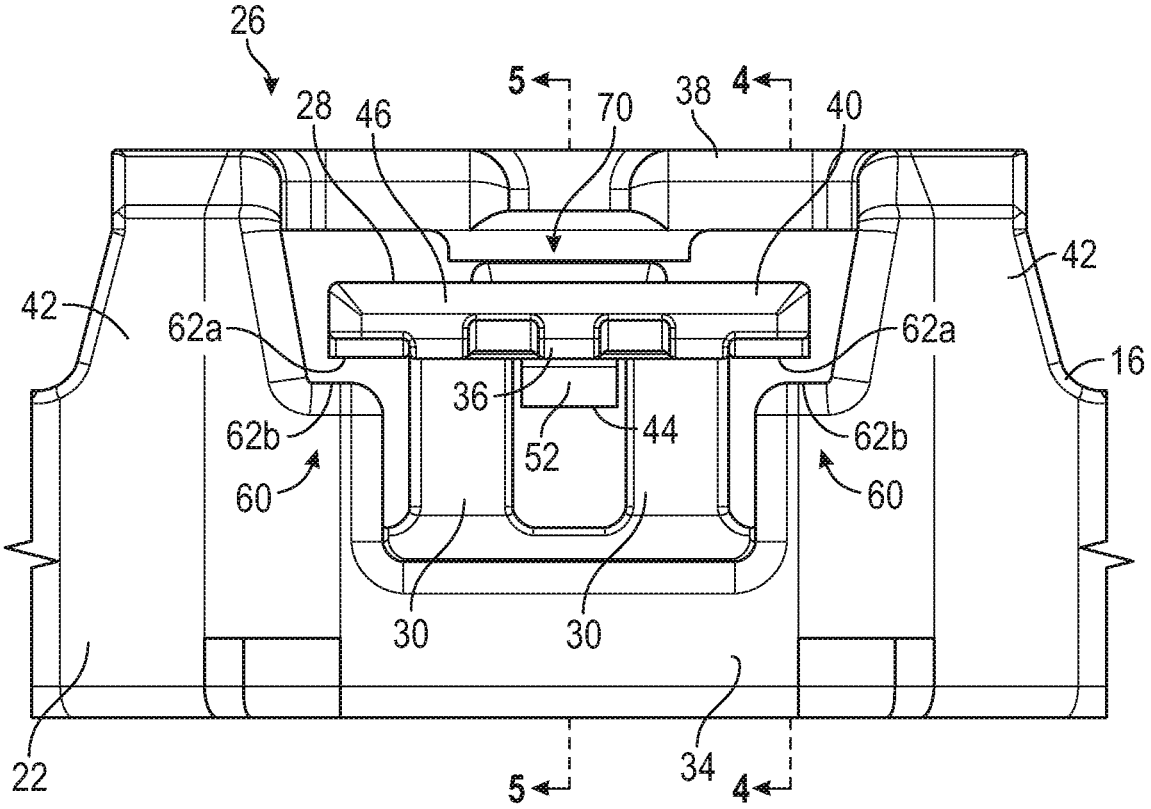
FIG. 3 is an end view of the portion of the lever including the lock.
Figure 4:
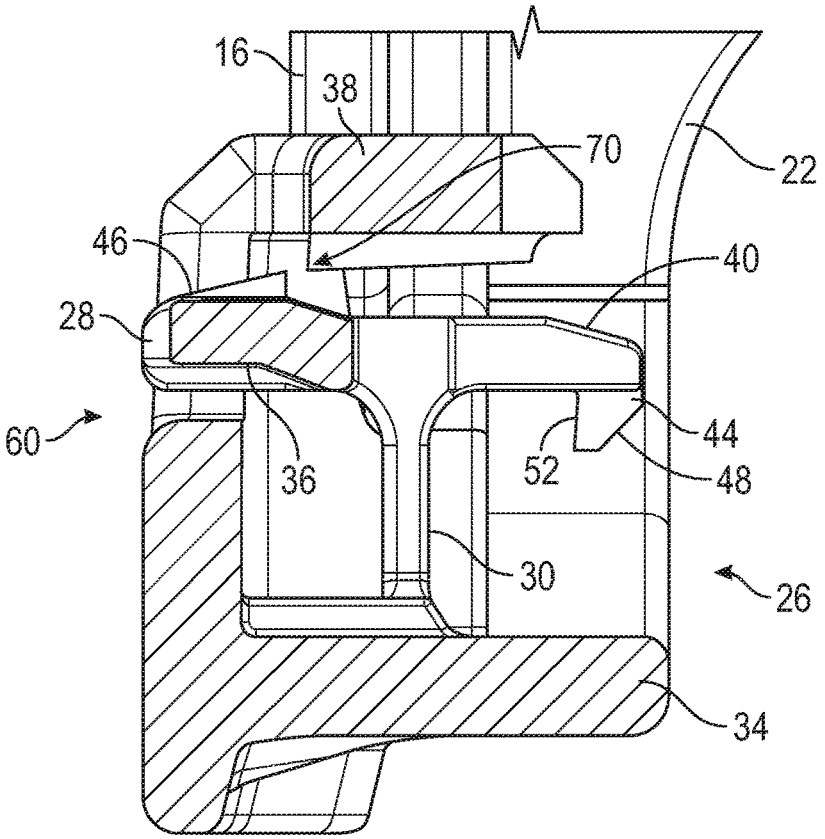
FIG. 4 is a cross-sectional view taken through the lock along line 4-4 of FIG. 3.

Referring to FIG. 2, there is shown an enlarged perspective view of a portion of the handle 22 and the lock 26. FIG. 3 is an end view of the same portion of the handle 22. FIG. 4 is a cross-sectional view taken along line 4-4 of FIG. 3 through a portion of the lock 26. The lock 26 includes a catch 28 that is attached to the handle 22 by relatively resilient catch legs 30. As will be described below, the catch 28 engages a strike 32 (shown in FIG. 1) on the electrical connector housing 15 when the lever 16 is moved to the final position. In the illustrated embodiment, the catch 28 is molded as part of the lever 16. However, the catch 28 may be a separate component, if desired.

The handle 22 includes a handle base 34 located on a first side 36 of the catch 28. The catch legs 30 extend from the handle base 22 to the first side 36 of the catch 28. The illustrated lock 26 includes two catch legs 30 but may include any desired number of catch legs 30. The handle 22 includes a lock cage 38 that is located on a second side 40 of the catch 28. The second side 40 is opposite the first side 36, and the catch 28 is located substantially between the handle base 34 and the lock cage 38. The lock cage 38 is attached to the handle base 34 by cage supports 42 (shown in FIG. 3) located on opposed sides of the catch 28. However, the lock cage 38 may be connected to the handle 22 by any desired support.

The catch 28 includes a tab 44 that extends from the first side 36 of the catch 28. The tab 44 engages the strike 32, as described below. The catch 28 includes a release surface 46 located on the second side 40 of the catch 28. The release surface 46 and the tab 44 are located on opposite sides of the catch legs 30. The lock cage 38 does not extend over the release surface 46 so that an operator is able to apply a force to the release surface 46, as described below.

Figure 5:
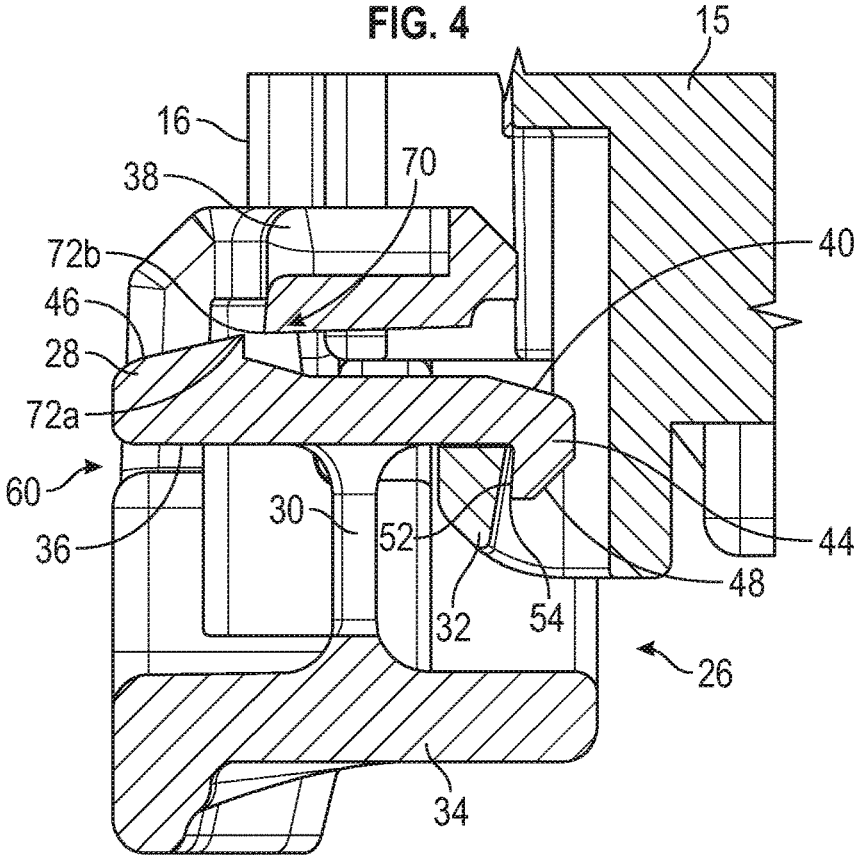
FIG. 5 is a cross-sectional view taken through the lock along line 5-5 of FIG. 3 when the lever is in a final position and the lock is engaged with a strike located on the first electrical connector.

Referring to FIG. 5, there is illustrated a cross-sectional view of the lock 26 taken along line 5-5 of FIG. 3 with the lock 26 shown when the lever 16 has been moved to the final position. As previously described, as the lever 16 is moved to the final position, the tab 44 on the catch 28 engages the strike 32 on the electrical connector housing 15. The tab 44 includes an open surface 48 on an outer edge that initially engages the strike 32. The open surface 48 is sloped so that the catch 28 is caused to move relative to the handle 22. The catch legs 30 flex, and the catch 28 is able to rotate in a forward direction 50 (shown in FIG. 6) relative to the handle 22. Once the lever 16 is moved to the final position, the tab 44 is clear of the strike 32, and the resilient catch legs 30 rebound so that the catch 28 is put in a closed position, as illustrated in FIG. 5. The tab 44 includes a retention surface 52 on the opposite side as the open surface 48. The retention surface 52 engages a strike surface 54 on the strike 32 to prevent the lever 16 from being moved away from final position. As a result, the lever 16 is locked in the final position relative to the electrical connector housing 15.

Figure 6:
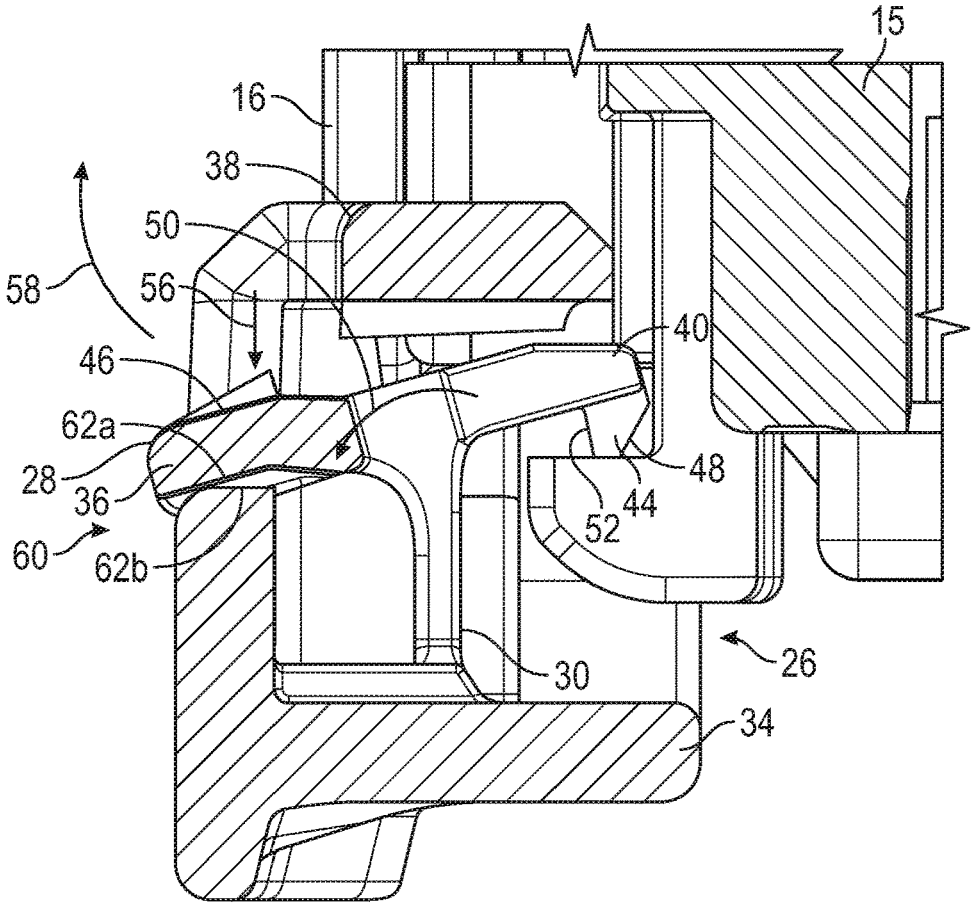
FIG. 6 is a cross-sectional view similar to FIG. 4, showing the lock opened to allow the lever to be moved relative to the first electrical connector.

Referring to FIG. 6, there is illustrated a cross-sectional view similar to FIG. 4 with the lock 26 shown when the lever 16 has been moved to the final position, and the catch 28 has been moved to an open position. This orientation occurs after the operator has applied a force 56 to the release surface 46 to cause the catch 28 to move relative to the handle 22. The catch legs 30 flex, and the catch 28 is able to rotate in the forward direction 50 relative to the handle 22. With the catch 28 in the open position, the lever 16 may be moved from the final position back toward the pre-mate position without the catch 28 engaging the strike 32. In order to move the lever 16 toward the pre-mate position, the handle 22 is moved in an unmate direction 58.

The lock 26 includes a forward stop, indicated generally at 60, which serves to limit the amount of movement of catch 28 in the forward direction 50. The forward stop 60 includes one or more catch forward stop surfaces **62*a* on the catch 28 and one or more handle forward stop surfaces 62*b* on the handle 22. The illustrated catch forward stop surfaces 62*a* are located on the first side 36 of the catch 28, which is the same side of the catch legs 30 as the release surface 46. However, the catch forward stop surfaces 62*a* may be on any desired part of the catch 28. The handle forward stop surfaces 62*b* are located so that they are engaged by the catch forward stop surfaces 62*a* when the catch 28 is moved in the forward direction 50. As seen in FIGS. 2 and 3, the illustrated catch 28 includes two catch forward stop surfaces 62*a* and two handle forward stop surfaces 62*b*. However, the catch 28 may include any desired number of forward stop surfaces 62*a* and 62*b***.

When the catch 28 has moved in the forward direction 50 far enough for the forward stop 60 to block further movement of the catch 28 relative to the handle 22, the catch legs 30 will be at their peak forward stress. Any increase in the force 56 applied to the release surface 46 will be transferred to the handle base 34 by the forward stop 60. Thus, the forward stop 60 can limit the amount of deformation of the catch legs 30.

Figure 7:
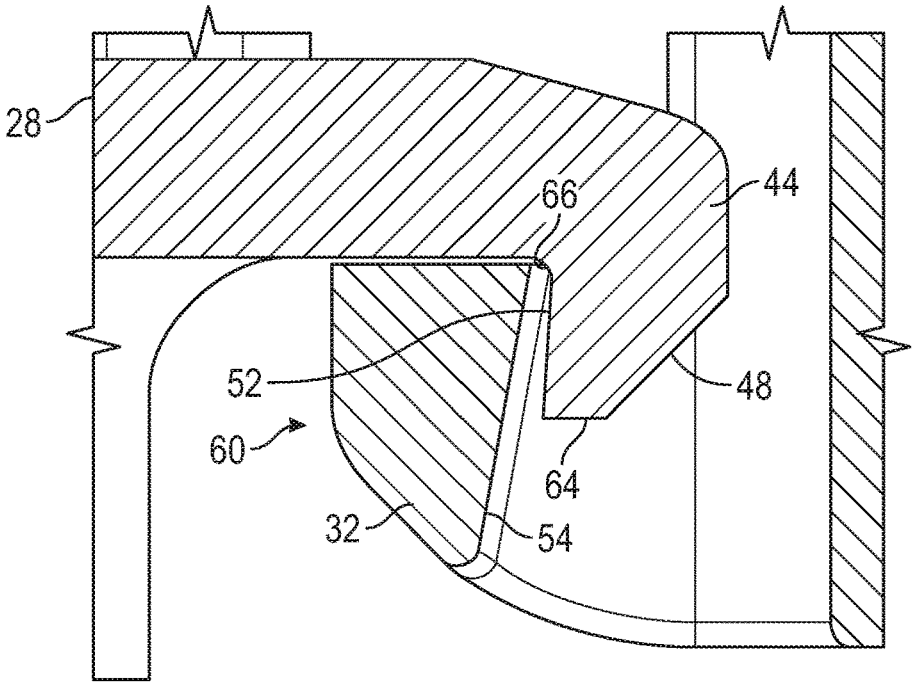
FIG. 7 is an enlarged view of a portion of FIG. 5.

Referring to FIG. 7, there is illustrated an enlarged, detail view of a portion of FIG. 5. As previously described, the retention surface 52 on the catch 28 engages the strike surface 54 on the strike 32 to prevent the lever 16 from being moved away from final position. When the lever 16 is in the final position and the catch 28 is in the locked position, the illustrated retention surface 52 has a different slope than the strike surface 54. As shown, the retention surface 52 and strike surface 54 are nearest to each other near the catch 28, and extend apart from each other toward an outer end 64 of the tab 44.

When the lever 16 is moved from the final position in the unmate direction 58 while the catch 28 is in the locked position, the catch 28 and the strike 32 will initially engage at an initial engagement location 66, where the retention surface 52 and the strike surface 54 are relatively close to each other. The catch 28 will then move relative to the strike 32, and additional parts of the catch 28 and the strike 32 will come into engagement. This causes the catch 28 to rotate in a reverse direction 68 relative to the handle 22.

Figure 8:
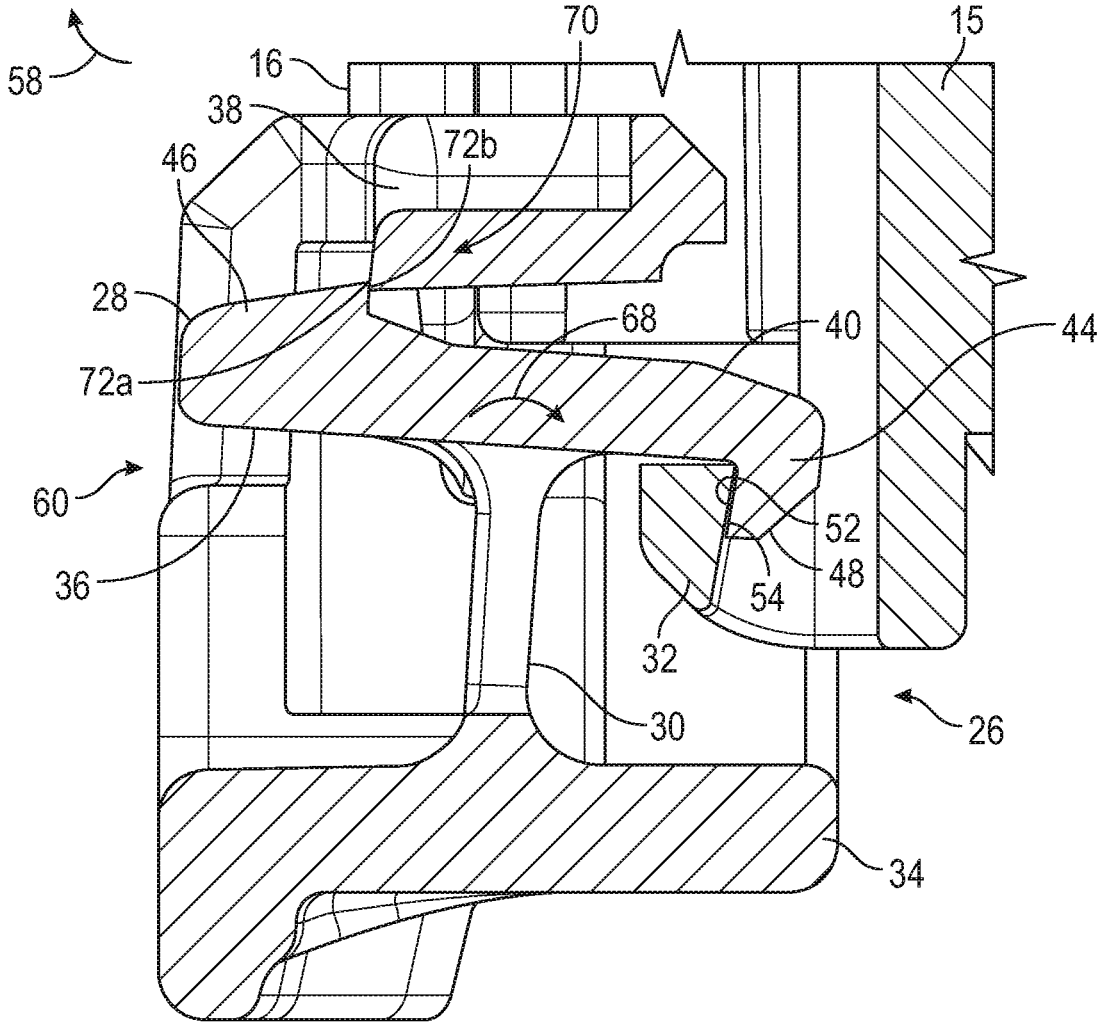
FIG. 8 is a cross-sectional view similar to FIG. 5, showing the lock engaged with the strike when a force is applied to pull the lever away from the final position.

Referring to FIG. 8, there is illustrated a cross-sectional view similar to FIG. 5, shown when a force has been applied to move the handle 22 in the unmate direction 58 while the catch 28 is in the closed position. The catch legs 30 flex, and the catch 28 is rotated in the reverse direction 68 relative to the handle 22. The engagement of the catch 28 with the strike 32 prevents movement of lever 16 away from the final position. Force applied to the lever 16 to move the lever 16 in the unmate direction is transferred through the catch legs 30 and through the catch 28.

The lock 26 includes a reverse stop, indicated generally at 70, that serves to limit the amount of movement of the catch 28 in the reverse direction 68. The reverse stop 70 includes a catch reverse stop surface 72*a* on the catch 28 and a handle reverse stop surface 72*b* on the handle 22. The illustrated catch reverse stop surface 72*a* is located on the second side 40 of the catch 28 and is located on the same side of the catch legs 30 as the release surface 46. However, the catch reverse stop surface 72*a* may be on any desired part of the catch 28. The handle reverse stop surface 72*b* is located on the lock cage 38 so that it is engaged by the catch forward stop surface 72*a* when the catch 28 is moved in the reverse direction 68. As shown in FIGS. 2 and 3, the illustrated catch 28 includes one catch reverse stop surface 72*a* and one handle reverse stop surface 72*b*. However, the catch 28 may include any desired number of reverse stop surfaces 72*a* and 72*b*.

When the catch reverse stop surface 72*a* has engaged the handle reverse stop surface 72*b*, the catch 28 is in a reverse stopped position, and a portion of the catch reverse stop surface 72*a* is located in the unmate direction 58 from the handle reverse stop surface 72*b*. As a result, additional force applied to the lever 16 to move the handle 22 in the unmate direction 58 can be transferred from the lock cage 38 to the catch 28 and to the strike 32. This reduces the amount of stress applied to the catch legs 30. This allows the catch legs 30 to be made so that they are sufficiently flexible when the operator moves the catch 28 to the open position, while providing a lock 26 that is able to resist the force applied to move the lever 16 in the unmate direction 58. If the force applied to the lever 16 is removed, the catch 28 will rebound to the closed position, and the handle 22 will return to the final position illustrated in FIG. 5.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

an electrical connector housing; and a lever that is supported on the electrical connector housing and movable relative to the electrical connector housing between a pre-mate position and a final position, the lever including a catch that is movable relative to the lever between an open position and a closed position, wherein when the lever is in the final position and the catch is in the closed position:

the catch retains the lever in the final position relative to the electrical connector housing, the catch is adapted to be moved in a forward direction relative to the lever to the open position wherein the catch does not retain the lever in the final position relative to the electrical connector housing, and the catch is adapted to be moved in a reverse direction relative to the lever when the lever is moved toward the pre-mate position.

2. The electrical connector of claim 1, further including a forward stop that limits the movement of the catch in the forward direction.

3. The electrical connector of claim 2, further including a reverse stop that limits the movement of the catch in the reverse direction.

4. The electrical connector of claim 1, further including a base located on the first side of the catch and a cage located on an opposed side of the catch, wherein the cage is attached to the base by one or more cage supports.

5. The electrical connector of claim 4, wherein the catch is adapted to engage the base to limit the movement of the catch in the forward direction, and wherein the catch is adapted to engage the cage in a reverse stopped position to limit the movement of the catch in the reverse direction.

6. The electrical connector of claim 5, wherein the lever is adapted to move in an unmate direction relative to the electrical connector housing from the final position to the pre-mate position, and wherein a portion of the catch is engaged with the cage and located in the unmate direction from the cage when the catch is in the reverse stopped position.

7. The electrical connector of claim 1, wherein the lever includes a base and a lock cage, the catch is attached to the base by one or more catch legs, and a portion of the catch is located between the base and the lock cage.

8. The electrical connector of claim 7, further including a forward stop that limits the movement of the catch in the forward direction.

9. The electrical connector of claim 8, further including a reverse stop that limits the movement of the catch in the reverse direction.

10. The electrical connector of claim 9, wherein the catch is adapted to engage the base to limit the movement of the catch in the forward direction.

11. The electrical connector of claim 10, wherein the catch is adapted to engage the cage in a reverse stopped position to limit the movement of the catch in the reverse direction.

12. The electrical connector of claim 11, wherein the lever is adapted to move in an unmate direction relative to the electrical connector housing from the final position to the pre-mate position, and wherein a portion of the catch is located in the unmate direction from the cage when the catch is in the reverse stopped position.

13. The electrical connector of claim 12, wherein when the catch is in the closed position and the lever is in the final position, a retention surface on the catch is adjacent to a strike surface on a strike, and wherein the retention surface and the strike surface are nearest to each other near the catch and extend apart from each other.

14. The electrical connector of claim 13, wherein when the catch is in the closed position and the lever is in the final position, the retention surface is adapted to engage the strike surface if the lever is moved in the unmate direction relative to the electrical connector housing.

15. The electrical connector of claim 1, further including a base located on the first side of the catch and a cage located on an opposed side of the catch, wherein:

the cage is attached to the base by one or more cage supports, the lever is adapted to move in an unmate direction relative to the electrical connector housing from the final position to the pre-mate position, the catch is adapted to engage the cage in a reverse stopped position to limit the movement of the catch in the reverse direction, and a portion of the catch is located in the unmate direction from the cage when the catch is in the reverse stopped position.

16. The electrical connector of claim 15, wherein when the catch is in the closed position and the lever is in the final position, a retention surface on the catch is adjacent to a strike surface on a strike, and wherein the retention surface and the strike surface are nearest to each other near the catch and extend apart from each other.

17. An electrical connector assembly comprising:

a first electrical connector including an electrical connector housing and a lever;

a second electrical connector;

the electrical connector housing including a strike with a strike surface;

the lever including two arms that are joined by a handle, each arm attached to an axle post on the electrical connector housing and the lever rotatable relative to the electrical connector housing between a pre-mate position and a final position, the lever adapted to engage the second electrical connector to move the second electrical connector into a mated position relative to the first electrical connector when the lever is moved to the final position, the lever adapted to move in an unmate direction from the final position to the pre-mate position; and the lever including a base and a catch that is attached to the base by one or more catch legs, the catch including a retention surface, the catch adapted to move relative to the base between an open position and a closed position, the lever also including a lock cage that is attached to the base by one or more cage supports; wherein the catch is adapted to move in a forward direction relative to the lever from the closed position to the open position and to engage the lever base;

when the catch is in the closed position and the lever is in the final position the retention surface is adjacent the strike surface, and the retention surface and the strike surface are nearest to each other near the catch and extend apart from each other; and when the catch is in the closed position, the lever is in the final position, and the lever is moved in the unmate direction, the retention surface engages the strike surface, and the catch is adapted to move in a reverse direction relative to the lever base to a reverse stopped position wherein a portion of the catch is engaged with the lock cage and located in the unmate direction from the lock cage.

18. An electrical connector assembly comprising:

a first electrical connector; and a second electrical connector, the second electrical connector including an electrical connector housing and a lever that is supported on the electrical connector housing and movable relative to the electrical connector housing between a pre-mate position, wherein the first electrical connector in the second electrical connector are not mated with one another, and a final position, wherein the first electrical connector in the second electrical connector are mated with one another, the lever including a catch that is movable relative to the lever between an open position and a closed position, wherein when the lever is in the final position and the catch is in the closed position:

the catch retains the lever in the final position relative to the electrical connector housing, the catch is adapted to be moved in a forward direction relative to the lever to the open position wherein the catch does not retain the lever in the final position relative to the electrical connector housing, and the catch is adapted to be moved in a reverse direction relative to the lever when the lever is moved toward the pre-mate position.

* * * * *